US007900280B2

(12) United States Patent
Thorpe et al.

(10) Patent No.: US 7,900,280 B2
(45) Date of Patent: Mar. 8, 2011

(54) GOGGLES

(75) Inventors: Christopher Thorpe, London (GB); Sean Hastings, London (GB)

(73) Assignee: Speedo International Limited, London (GB)

( * ) Notice: Subject to any disclaimer, the term of this patent is extended or adjusted under 35 U.S.C. 154(b) by 766 days.

(21) Appl. No.: 11/748,615

(22) Filed: May 15, 2007

(65) Prior Publication Data

US 2007/0289048 A1 Dec. 20, 2007

(30) Foreign Application Priority Data

May 18, 2006 (GB) ..... 0609919.6

(51) Int. Cl.
*A61F 9/02* (2006.01)

(52) U.S. Cl. ..... 2/428

(58) Field of Classification Search ..... 2/427–429
See application file for complete search history.

(56) References Cited

U.S. PATENT DOCUMENTS

| | | | | |
|---|---|---|---|---|
| 1,547,040 | A | | 7/1925 | Humphrey |
| 1,839,386 | A | | 1/1932 | Fischer |
| 1,850,812 | A | | 3/1932 | Scharf |
| 1,928,358 | A | | 9/1933 | Malcom |
| 1,938,924 | A | | 12/1933 | Meyrowitz et al. |
| 2,007,186 | A | | 7/1935 | Farrell |
| 2,026,435 | A | | 12/1935 | Ratti |
| 2,150,791 | A | | 3/1939 | Welsh |
| 2,182,104 | A | | 12/1939 | Wilen et al. |
| 2,333,336 | A | | 11/1943 | Powell |
| 2,356,731 | A | | 8/1944 | Balanon |
| 2,362,917 | A | | 11/1944 | Malcom |
| 2,393,533 | A | | 1/1946 | Heinz |
| 2,420,281 | A | | 5/1947 | Zbar |
| 2,488,235 | A | | 11/1949 | Pfeiffer |
| 2,524,245 | A | | 10/1950 | Wold |
| 2,526,181 | A | | 10/1950 | Wilen |
| 2,709,256 | A | * | 5/1955 | Baratelli ..... 2/447 |
| 2,909,959 | A | | 10/1959 | Girden |
| 2,928,097 | A | | 3/1960 | Neufeld |
| 3,012,248 | A | | 12/1961 | Kleinman |
| 3,020,911 | A | | 2/1962 | Girden |
| 3,027,562 | A | | 4/1962 | Widenor |
| 3,037,313 | A | | 6/1962 | Gring |
| 3,040,616 | A | | 6/1962 | Simpson |
| 3,051,957 | A | | 9/1962 | Chan |
| 3,052,887 | A | * | 9/1962 | Sockel et al. ..... 2/9 |
| 3,186,005 | A | | 6/1965 | Gentile |
| 3,483,569 | A | | 12/1969 | Armendariz |

(Continued)

FOREIGN PATENT DOCUMENTS

CA 2 123 375 A1 11/1995

(Continued)

*Primary Examiner* — Katherine Moran
(74) *Attorney, Agent, or Firm* — Stites & Harbison PLLC; Marvin Petry; Stephen J. Weyer

(57) ABSTRACT

Goggles are provided having a lens cup with a seal portion extending around its peripheral rear edge. The seal portion is adapted to seal against the face of a wearer of the goggles via a face contact surface. The face contact surface is preformed to follow substantially the contours of the wearer's face around the wearer's eye socket, so that little force between the seal portion and the wearer's face is required to achieve sealing. The face contact surface may be preformed in accordance with the average wearer from a demographic group or preformed bespoke for the wearer.

15 Claims, 9 Drawing Sheets

U.S. PATENT DOCUMENTS

| | | | | | |
|---|---|---|---|---|---|
| 3,653,086 | A | | 4/1972 | Gongwer | |
| 3,671,976 | A | | 6/1972 | Johnson et al. | |
| 3,710,393 | A | | 1/1973 | Douglas | |
| 3,725,953 | A | | 4/1973 | Johnson et al. | |
| 3,755,819 | A | | 9/1973 | Douglas | |
| 3,787,688 | A | | 1/1974 | Stone | |
| 3,895,397 | A | | 7/1975 | Douglas | |
| 4,051,557 | A | * | 10/1977 | Bengtson et al. | 2/430 |
| 4,087,865 | A | | 5/1978 | Garofalo | |
| 4,171,543 | A | | 10/1979 | Cressi | |
| 4,256,386 | A | | 3/1981 | Herbert | |
| 4,264,987 | A | * | 5/1981 | Runckel | 2/428 |
| 4,279,039 | A | | 7/1981 | Drew | |
| 4,689,837 | A | | 9/1987 | Bollé | |
| 4,755,040 | A | | 7/1988 | Haslbeck | |
| 4,896,380 | A | | 1/1990 | Kamitani | |
| 5,073,324 | A | | 12/1991 | Beaudet | |
| 5,093,940 | A | | 3/1992 | Nishiyama | |
| 5,129,109 | A | | 7/1992 | Runckel | |
| 5,191,363 | A | | 3/1993 | Smith et al. | |
| 5,191,364 | A | | 3/1993 | Kopfer | |
| 5,204,700 | A | | 4/1993 | Sansalone | |
| 5,331,691 | A | | 7/1994 | Runckel | |
| 5,408,702 | A | | 4/1995 | Chiang | |
| 5,422,684 | A | | 6/1995 | Keller | |
| 5,517,700 | A | | 5/1996 | Hoffman | |
| 5,546,611 | A | | 8/1996 | Lathrop | |
| 5,572,989 | A | | 11/1996 | Lutz et al. | |
| 5,575,277 | A | | 11/1996 | Lutz et al. | |
| 5,628,072 | A | | 5/1997 | Haslbeck et al. | |
| 5,650,866 | A | | 7/1997 | Haslbeck | |
| 5,655,228 | A | | 8/1997 | Chiang | |
| 5,657,493 | A | | 8/1997 | Ferrero et al. | |
| 5,742,946 | A | | 4/1998 | Garofalo | |
| 5,764,332 | A | | 6/1998 | Kranhouse | |
| 5,878,443 | A | | 3/1999 | Seiler | |
| 5,894,606 | A | | 4/1999 | Chiang | |
| 5,896,588 | A | | 4/1999 | Chiang | |
| 5,915,541 | A | | 6/1999 | Beltrani | |
| 5,927,281 | A | | 7/1999 | Monteleone et al. | |
| 5,950,247 | A | | 9/1999 | Huang | |
| 5,966,745 | A | | 10/1999 | Schwartz et al. | |
| 6,023,791 | A | | 2/2000 | Chiang | |
| 6,032,298 | A | | 3/2000 | Chiang | |
| 6,070,272 | A | | 6/2000 | Chiang | |
| 6,089,233 | A | | 7/2000 | Sharon et al. | |
| 6,098,206 | A | | 8/2000 | Chou | |
| 6,112,334 | A | | 9/2000 | Chiang | |
| 6,119,277 | A | | 9/2000 | Chiang | |
| 6,155,253 | A | | 12/2000 | Gamberini | |
| 6,247,811 | B1 | | 6/2001 | Rhoades et al. | |
| 6,253,387 | B1 | | 7/2001 | Yu | |
| 6,272,693 | B1 | | 8/2001 | Godoy | |
| 6,282,727 | B1 | | 9/2001 | Lindahl | |
| 6,289,523 | B1 | | 9/2001 | Chiang | |
| 6,317,897 | B1 | | 11/2001 | Chiang | |
| 6,321,390 | B1 | * | 11/2001 | Chiang | 2/428 |
| 6,343,386 | B1 | | 2/2002 | Chou | |
| 6,349,418 | B1 | | 2/2002 | Chiang | |
| 6,505,353 | B2 | | 1/2003 | Sung | |
| 6,513,170 | B1 | | 2/2003 | Chiang | |
| 6,560,788 | B1 | | 5/2003 | Beltrani | |
| 6,574,802 | B2 | | 6/2003 | Chiang | |
| 6,581,213 | B2 | | 6/2003 | Chiang | |
| 6,604,247 | B2 | | 8/2003 | Chiang | |
| 6,626,178 | B2 | | 9/2003 | Morgan et al. | |
| 6,666,210 | B2 | | 12/2003 | Semeia | |
| 6,694,533 | B2 | | 2/2004 | Chiang | |
| 6,698,033 | B2 | | 3/2004 | Fujima | |
| 6,711,754 | B2 | | 3/2004 | Chou | |
| 6,718,560 | B2 | | 4/2004 | Godoy | |
| 6,721,963 | B1 | | 4/2004 | Kawashima | |
| 6,748,608 | B1 | | 6/2004 | Fukazawa | |
| 6,775,850 | B1 | | 8/2004 | Grilliot et al. | |
| 6,880,177 | B2 | | 4/2005 | Sung | |
| 2002/0170107 | A1 | | 11/2002 | Garofalo | |
| 2003/0084500 | A1 | | 5/2003 | Testa et al. | |
| 2003/0106140 | A1 | | 6/2003 | Bruno | |
| 2003/0229935 | A1 | | 12/2003 | Chou | |
| 2004/0187198 | A1 | | 9/2004 | Chiang | |
| 2005/0066967 | A1 | | 3/2005 | Jacob | |
| 2005/0081282 | A1 | | 4/2005 | Yu | |
| 2005/0193479 | A1 | | 9/2005 | Atta et al. | |
| 2005/0273910 | A1 | | 12/2005 | Cozens et al. | |
| 2006/0072065 | A1 | | 4/2006 | Fernandez et al. | |

FOREIGN PATENT DOCUMENTS

| | | | |
|---|---|---|---|
| DE | 201 13 478 | U1 | 2/2002 |
| EP | 0 072 229 | A1 | 2/1983 |
| EP | 0 827 761 | B1 | 3/1998 |
| EP | 0 860 184 | A1 | 8/1998 |
| EP | 1 184 053 | B1 | 3/2002 |
| EP | 1 197 246 | A1 | 4/2002 |
| EP | 1 203 600 | A1 | 5/2002 |
| EP | 1 293 233 | A1 | 3/2003 |
| EP | 1 516 650 | A1 | 3/2005 |
| GB | 188 872 | A | 11/1922 |
| GB | 194 164 | A | 3/1923 |
| GB | 369 338 | A | 3/1932 |
| GB | 417 223 | A | 10/1934 |
| GB | 433 384 | A | 8/1935 |
| GB | 612 577 | A | 11/1948 |
| GB | 616 213 | A | 1/1949 |
| GB | 616 976 | A | 1/1949 |
| GB | 638 646 | A | 6/1950 |
| GB | 678 331 | A | 11/1952 |
| GB | 820 353 | A | 9/1959 |
| GB | 840 638 | A | 7/1960 |
| GB | 932 258 | A | 7/1963 |
| GB | 1 010 573 | A | 11/1965 |
| GB | 1 349 416 | A | 4/1974 |
| GB | 1 349 417 | A | 4/1974 |
| GB | 1 431 954 | A | 4/1976 |
| GB | 1 531 986 | A | 11/1978 |
| GB | 2 283 333 | A | 5/1995 |
| GB | 2 311 620 | B | 10/1997 |
| GB | 2 312 967 | B | 11/1997 |
| GB | 2 326 078 | B | 12/1998 |
| GB | 2 347 629 | A | 9/2000 |
| GB | 2 355 311 | B | 4/2001 |
| GB | 2 351 358 | B | 10/2001 |
| GB | 2 400 184 | A | 10/2004 |
| GB | 2 400 185 | A | 10/2004 |
| GB | 2 403 555 | A | 1/2005 |
| GB | 2 403 556 | A | 1/2005 |
| WO | WO 90/00380 | A1 | 1/1990 |
| WO | WO 90/09209 | A2 | 8/1990 |
| WO | WO 93/19814 | A1 | 10/1993 |
| WO | WO 94/02087 | A1 | 2/1994 |
| WO | WO 94/02088 | A1 | 2/1994 |
| WO | WO 96/24315 | A1 | 8/1996 |
| WO | WO 98/48905 | A1 | 11/1998 |
| WO | WO 98/55163 | A2 | 12/1998 |
| WO | WO 00/02505 | A1 | 1/2000 |
| WO | WO 02/41953 | A1 | 5/2002 |
| WO | WO 02/45804 | A1 | 6/2002 |
| WO | WO 03/089072 | A1 | 10/2003 |
| WO | WO 2005/016467 | A1 | 2/2005 |

* cited by examiner

GOGGLES

This invention relates to goggles, and particularly but not exclusively to sports goggles, e.g. swimming goggles.

Conventional swimming goggles have two lens cups. Each lens cup includes a rearwardly-directed peripheral seal portion which is adapted to seal against the wearer's face to enclose the space behind the lens cup. The lens cups are connected to one another at their medial sides (the sides adjacent the wearer's nose) by a bridging section that is adapted to extend across the wearer's nose. A head strap is fixed to the lateral sides of the lens cup (the sides adjacent the wearer's ears) and is adapted to extend round the back of the wearer's head to hold the goggles in position.

Commonly, the seal portion is an annular foam pad. The foam pad is designed to distort to conform to the wearer's face, under pressure applied to the pad via the head strap. The head strap must be tight to achieve an effective seal between the pad and the wearer's face, which can cause discomfort to the wearer.

As a common alternative to the foam pad, an annular flexible rubber flange is often used as a seal portion, extending obliquely from the rim at a generally uniform angle relative to peripheral walls of the lens cup. This seal is sometimes known as a gasket-type seal. This flange is designed to distort substantially to conform with the wearer's face by expelling air from the space behind the lens cup upon contact with the wearer's face. The air expulsion creates a suction-effect, causing the seal portion to press against the wearer's face, ensuring adequate sealing.

However, the suction force required to ensure adequate sealing can cause substantial discomfort to the wearer. This is evidenced by the red marking normally visible around the wearer's eye sockets after removal of the goggles. The red marking results from distortion to the facial tissue and subcutaneous musculature.

It is a general proposition of the present invention to provide a seal portion for a goggle lens cup which is preshaped or preformed to conform substantially with a wearer's face (i.e. it does not rely on any significant pressure against the face to give its conforming shape). Accordingly, little force may be needed to seal the lens cup adequately with the wearer's face since significant distortion of the seal portion and/or the wearer's face to obtain an adequate seal may not be necessary.

According to a first aspect of the present invention there is provided:

goggles, comprising:

a lens cup having a peripheral rear edge, a seal portion extending around the peripheral rear edge, adapted to seal against a wearer's face, wherein the seal portion has a face contact surface preformed to follow substantially the contours of the wearer's face around the wearer's eye socket.

Preferably, the profile of the wearer's face around the wearer's eye socket is in the region adjacent the maxilla, zygomatic and frontal bone arches, adjacent to the eye socket, and the side of the nasal bone where the nasal bone meets the frontal and maxilla bones.

The term 'preformed' is used to indicate that the face contact surface is shaped to follow substantially the contours of a wearer's face around the wearer's eye socket prior to any contact with the face. The face contact surface is the surface of the seal portion that contacts the face when the goggles are worn.

The seal portion may be formed integrally with the lens cup, e.g. it may be the peripheral rear edge (rim) of the lens cup itself. By having a seal portion integral with the lens cup, manufacture of the goggles is simplified. Furthermore, the goggles may be more resilient, since there are fewer parts that can come apart undesirably. Also, they may be less bulky, reducing the amount by which they project forward of the brow when worn, potentially improving the hydrodynamics.

Alternatively, the seal portion may be a separate element fitted to the peripheral edge of the lens cup, such as a gasket or a pad. The gasket may be rubber and may lie flat against the peripheral rear edge of the lens cup, following the contours of the rear edge. Preferably, the pad is filled with a viscous fill substance such as a gel or gel-like fill substance. The pad seal portion may have a generally U-shaped cross section, with the fill substance being contained in the cavity formed by the U-shape and the peripheral rear edge of the lens cup. The base of the U-shape is provided by the face contacting surface. The U-shaped seal is less prone to creasing than a tubular seal portion. Nevertheless, alternatively, the seal portion may be tubular. Accordingly, it may have a cross-section that is generally circular, elliptical, or polygonal etc. Thus, a complete cavity containing the fill substance may be provided by the seal portion. Preferably, the peripheral rear edge of the lens cup is contoured in a similar or identical manner to the face contact surface of the pad seal portion, so that the depth of the cavity may remain substantially the same around the entire peripheral rear edge. This may make construction simpler.

When the seal portion is a gasket or a pad in particular, the seal portion may be resiliently deformable. Accordingly, if the face contact surface of the seal portion does not conform exactly to the wearer's face contours, the difference can be accommodated by some deformation of the seal portion. If the peripheral edge of the lens cup provides the seal portion, and this peripheral portion is rigid, the difference may be accommodated by distortion of the wearer's facial tissue. However, since the face contact surface is preformed to follow substantially the contours of the wearer's face, this distortion will be minimal, and may be much less than in conventional goggles. Accordingly, relatively low contact forces are required between the seal portion and the wearer's face in order to effect an adequate seal. Thus, discomfort to the wearer may be reduced; the distortion of the tissue and subcutaneous musculature around the eye socket of the wearer is minimised, reducing the likelihood of any reddening of the face. Since high contact forces are not necessary, the tension of a head strap, for holding the goggles to a wearer's face may be kept relatively low.

The seal portion may comprise a flange. The flange may project from the face contact surface. The flange may extend right around the face contact surface, or just a part of the face contact surface. Preferably, the flange is resiliently deformable, e.g. is formed of rubber material, so that it may deform on contact with the face. The flange may be particularly advantageous when the peripheral edge of the lens cup provides the face contact surface, since it may add some deformability to an otherwise rigid seal portion, improving its sealing properties. Nevertheless, the flange may be much smaller than in conventional goggles, and may provide merely an auxiliary sealing feature to the seal portion, to improve further its sealing properties.

The contact surface of the seal portion may be preformed to follow the facial contours of the 'average' wearer. However, since the facial structure of persons can vary significantly between different demographic groups, e.g., based on their ethnic background, gender and age etc., preferably, the face contact surface of the seal portion is preformed to follow substantially the average contours of a wearer's face belonging to a specific demographic group. Accordingly, numerous goggles variants according to the present invention may be provided, each for a different demographic group, such as Caucasian adult male, African adult female, Chinese child male etc. Thus, assuming that the correct seal portion is used by a wearer for their demographic group, the need for any deformation of the seal portion and/or the wearer's face, to effect adequate sealing, may be minimised.

Alternatively, the face contact surface may be preformed bespoke to the wearer. To achieve this, moulds of the wearer's face etc. may be taken prior to manufacture.

Since the face contact surface is preformed to follow substantially the contours of a wearer's face around the wearer's eye socket, adjustment of the seal portion in order to locate in the correct position of the wearer's face, may be minimised. Furthermore, since the face contact surface is preformed to substantially follow the contours of a wearer's face around the wearer's eye socket, the seal portion may have a relatively small depth, e.g. less than 10 mm, or even less than 5 mm depth. Accordingly, the seal portion need not obscure substantially the wearer's field of view. Still furthermore, the nature of the geometry of the face contact surface is such that moulding of the seal portion, and/or lens cup may be performed easily, without the need for any re-entrant angles.

To aid a more detailed description of the seal portion, 'x-', 'y-' and 'z-directions' of the lens cup/seal portion/face contact surface, and different regions of the seal portion will now be defined. The z-direction is perpendicular to the best-fit plane of the contact surface (defined below). When the lens cup is worn, the z-direction runs, generally, in a direction normal to the surface of the centre of the pupil of the wearer's eye. The zero point of an axis along the z-direction is located on the best-fit plane, and the positive side of the axis extends toward the eye of the wearer, in use, and the negative side extends away from the wearer's eye, in use. The x-and y-directions lie, perpendicular to each other, along the best fit plane of the contact surface (and hence perpendicular to the z-plane). When the lens cup is worn by a wearer with head upright, the x-direction runs generally horizontally across the wearer's face, and the y-direction runs generally vertically, up and down the wearer's face.

For the purposes of this description, the seal portion is divided up into four regions: a medial region, a lateral region, a top region and a bottom region. The medial region is a part of the seal portion which, when worn, is adjacent the wearer's nose. The medial region is situated at the medial end of the seal portion. The lateral region is located at the opposite side of the seal portion from the medial region, in the x-direction, and is a part of the seal portion, which, when worn, is nearest the wearer's ears. The lateral region is situated at the lateral end of the seal portion. The upper region, and the lower region, are the parts of the seal portion positioned intermediate the lateral and medial regions and which, when worn, are nearest the top of the wearer's head and the wearer's chin respectively.

To aid understanding, FIG. 1 shows an example face contact surface 11 of the seal portion 1 of a lens cup according to present invention situated in position adjacent the eye socket of a wearer's face 2. The x-, y-, and z-directions are marked in FIG. 1 along with the medial region 12 (indicated by dotted-circle 12), lateral region 13 (indicated by dotted circle 13), upper region 14, lower region 15, medial end 16 and lateral end 17 of the seal portion. FIG. 2*a* shows an even distribution of points 21 over the face contact surface. The best-fit plane 22 is calculated as a best-fit plane through these points 21, as shown in FIG. 2*b*.

The central axis of the contact surface is a line which runs along the centre of the contact surface as it extends around the peripheral edge of the lens cup. In this description, the width of the face contact surface at a particular position is taken to be the distance between the sides of the face contact surface in a direction perpendicular to the central axis, at that position. (The dotted line 23 in FIG. 1 indicates the central axis 23 of the face contact surface 11 of FIG. 1, and the width at a sample position of the face contact surface is indicated by arrow 24).

Preferably, the width of the face contact surface is greater at the medial and/or lateral regions than at the upper and lower regions.

A wider face contact surface is generally more compliable. This is particularly advantageous at the medial region, since the medial region will normally contact the wearer's face adjacent the nasal bone. This part of the face is relatively firm, i.e. non-compliable, and is likely to vary significantly from one wearer to the next. By having a relatively compliable contact surface, any differences between the actual wearer and e.g. the 'average' wearer for which the seal portion is designed, may be accommodated more easily, and an adequate seal effected. Preferably, the width of the face contact surface is from 5 mm to 9 mm at the medial region.

A relatively wide face contact surface is desirable at the lateral region since, normally, contact forces applied to the face by the lateral region of the face contact surface are relatively low. By having a wide contact surface, better sealing is achieved between the contact surface and the face, despite the low contact forces at this point. Forces are normally lower at this position than elsewhere since, at this position, the dominant force applied to the seal portion is from a head strap of the goggles and the dominant force acts in a direction substantially perpendicular to the direction of contact between the seal portion and the wearer's face. Preferably, the width of the face contact surface is from 8 mm to 12 mm at the lateral region.

Preferably, the ratio of the spatial extent of the face contact surface in the x-direction to the spatial extent of the face contact surface in the y-direction is between 1.4 and 1.5. Preferably, the maximum distance between the upper region and the lower region of the contact surface, in the y-direction is 50 mm. Accordingly, interference between the lens cup and the natural movement of the eye and eye lid when worn, may be minimised or even eliminated.

Preferably, the face contact surface curves in the z-direction as it extends from the medial to the lateral end generally in the x-direction. Preferably, the range of deviation of the contact surface from the best-fit plane of the contact surface in the z-direction, as it curves, is at least 2 mm, more preferably at least 3 mm, even more preferably at least 5 mm either side of the best-fit plane. Preferably, the total deviation in the z-direction is at least 5 mm, more preferably at least 10 mm. This degree of curvature enables the face contact surface to follow substantially the contours of the wearer's face.

Preferably, the local plane (rather than the best fit plane) of the face contact surface has an angle at the medial region 42 and the lateral region 43 of between 30 and 60 degrees relative to the xy-plane. Accordingly, the face contact surface may face in generally the same direction in the medial and lateral regions. Preferably, the local plane of the face contact surfaces at the upper and lower regions has a shallower angle relative to the xy-plane than at the medial and lateral regions. In fact, the plane at the upper and lower regions may approach or reach a zero-degree angle relative to the xy plane, so the plane may be substantially parallel to the xy-plane at these points.

The face contact surface of the seal portion may be joined to the rest of the lens cup via side walls of the seal portion, or, if the seal portion is integral with the lens cup, as described above, the face contact surface may be joined directly to side walls of the lens cup. Preferably, a smooth transition is provided between the contact surface and the side walls. To facilitate the smooth transition, curved corner portions may be provided at the interface between the face contact surface and the side walls. Alternatively, the face contact surface may blend into the sidewalls so that there are no corner portions. A smooth transition improves comfort for the wearer. Preferably, at the medial region of the face contact area, the radii of the curved corners are between 1.2 mm and 3 mm. A smooth transition is particularly important at the medial region, since the contact force between the contact surface and the wearer's face is relatively high at this position as described above, and any sharp edges at the interface between the face contact surface and the sidewalls would be very noticeable to the wearer.

According to a second aspect of the present invention, there is provided:

goggles, comprising:

a lens cup having a peripheral rear edge, a seal portion extending around the peripheral rear edge, adapted to seal against a wearer's face, wherein the seal portion has a face contact surface the orientation of which changes continuously in two or more of the x-, y-and z-directions of the lens cup as it extends around the peripheral rear edge of the lens cup.

One or more features of the first and second aspects of the present invention may be combined.

The orientation of the face contact surface may change in two of the x-, y-and z-directions around a part of the peripheral read edge, and a different two of the x-, y-and z-directions around another part of the peripheral rear edge. For example, the orientation of the face contact surface may change in the x-and z-directions as it extends around part of the peripheral rear edge, whereas it may change in the y-and z-directions as it extends around another part of the peripheral rear edge.

Furthermore, the orientation of the face contact surface may change in two of the x-, y-and z-directions around a region of the peripheral rear edge, and all three x-, y-and z-directions around another region of the peripheral rear edge. For example, the orientation of the face contact surface may change in the x-, y-and z-directions as it extends around part of the peripheral rear edge, whereas it may change in only the y-and z-directions as it extends around another part of the peripheral rear edge.

Preferably, the orientation of the face contact surface changes continuously in all of the x-, y-and z-directions.

By continually changing orientation in two or all of the x-, y-and z-directions, the contact surface may follow substantially the contours of the wearer's face.

Preferably, the lens cup has curvature in the x-, y-and z-directions. This may reduce the level of hydrodynamic drag when used, improving performance.

According to a third aspect of the present invention, there is provided a seal portion for goggles substantially as described with respect to the first and second aspects of the present invention.

Embodiments of the present invention are now described with reference to the accompanying drawings, in which:

FIGS. 1 show the position of a face contact surface of a seal portion according to the present invention relative to a wearer's face;

FIG. 2*a* and 2*b* indicate how the best-fit plane of the face contact surface according to present invention is determined;

Figure 3:
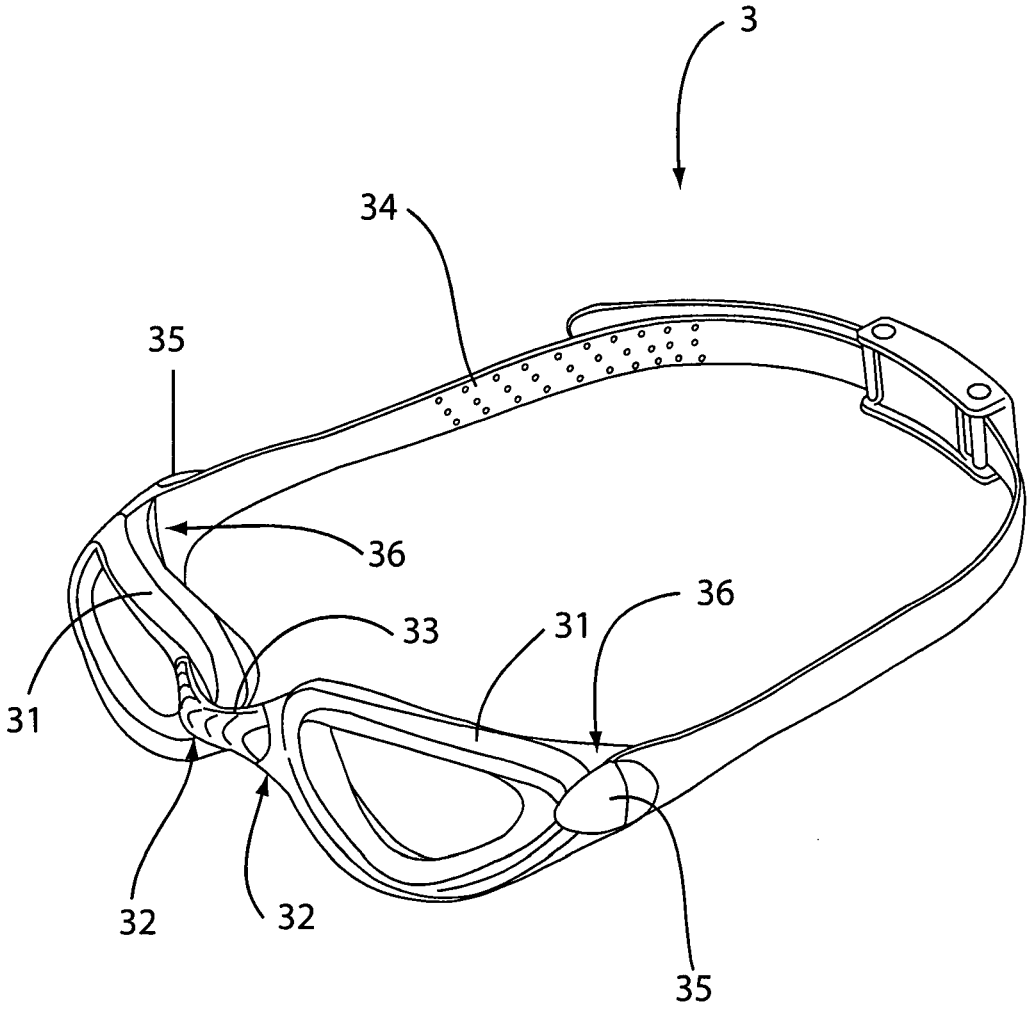
FIG. 3 shows a front oblique view of goggles according to a first embodiment of the present invention.
Figure 5A:
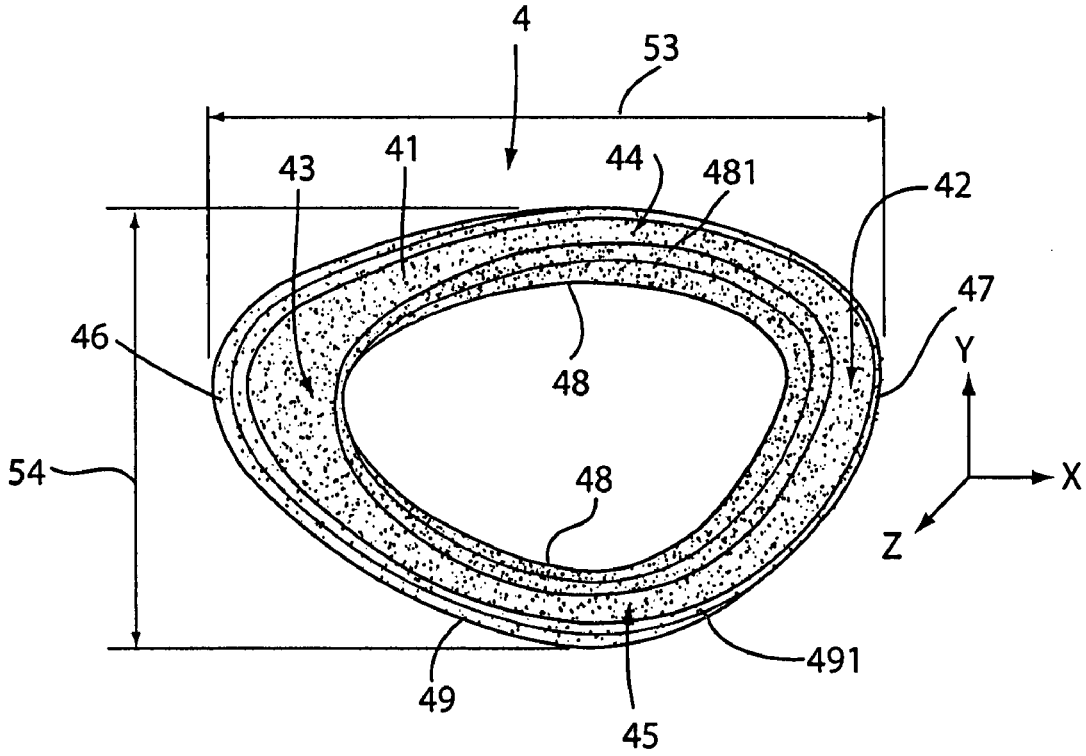
Figure 5B:
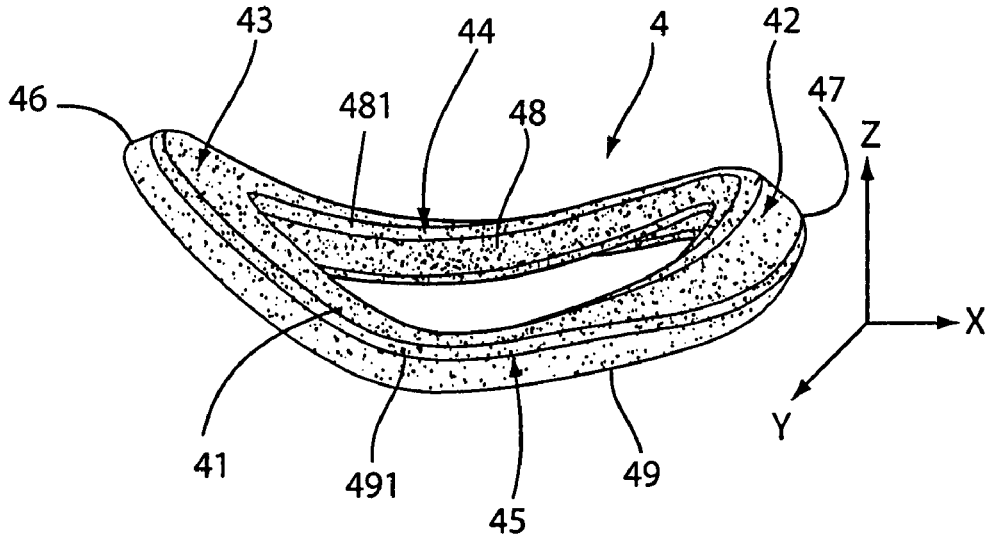
Figure 6A:
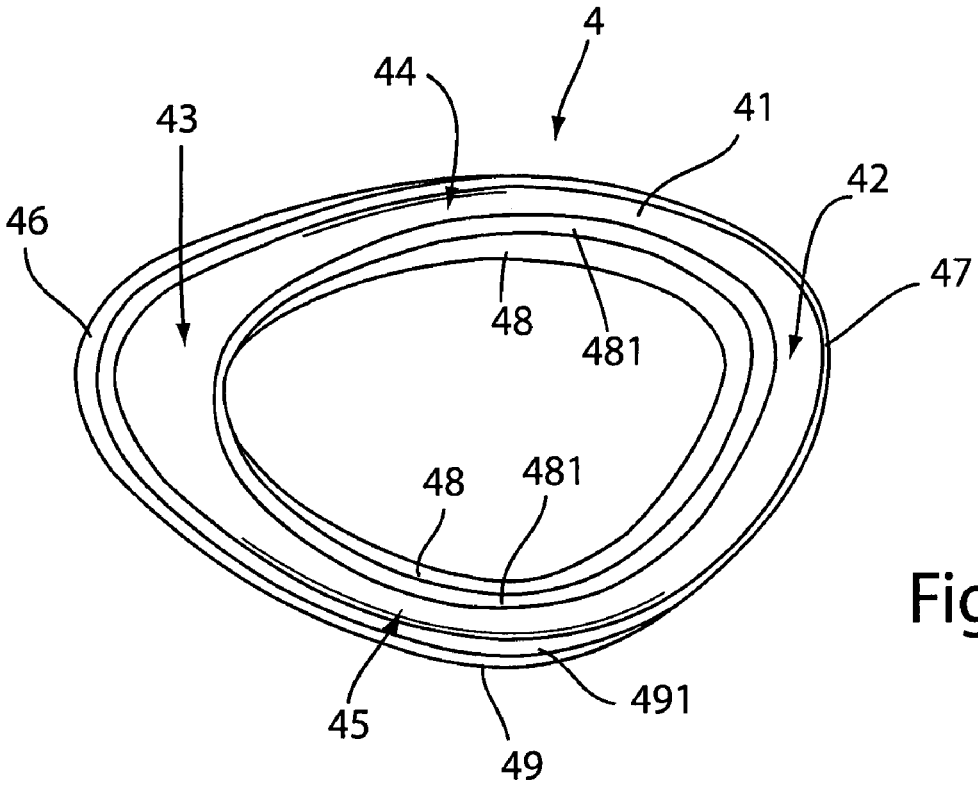
Figure 6B:
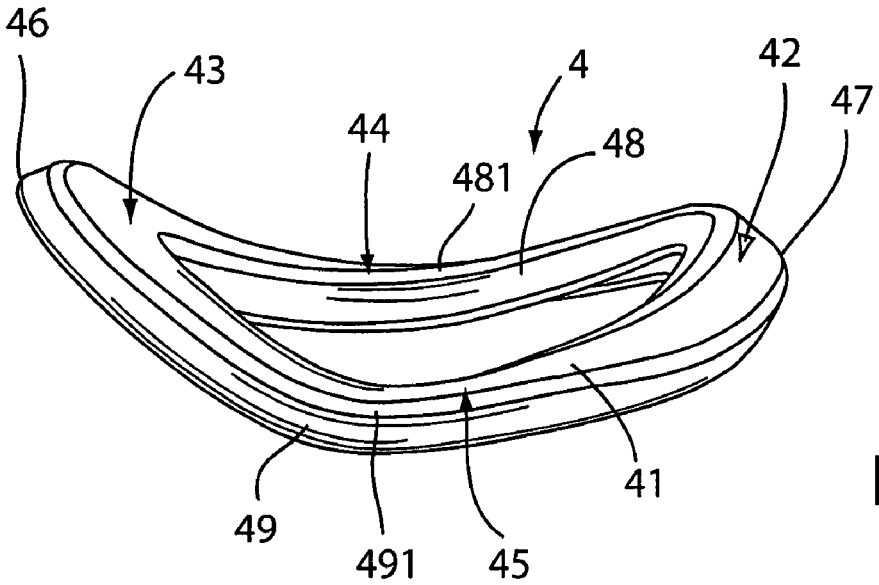
Figure 7A:
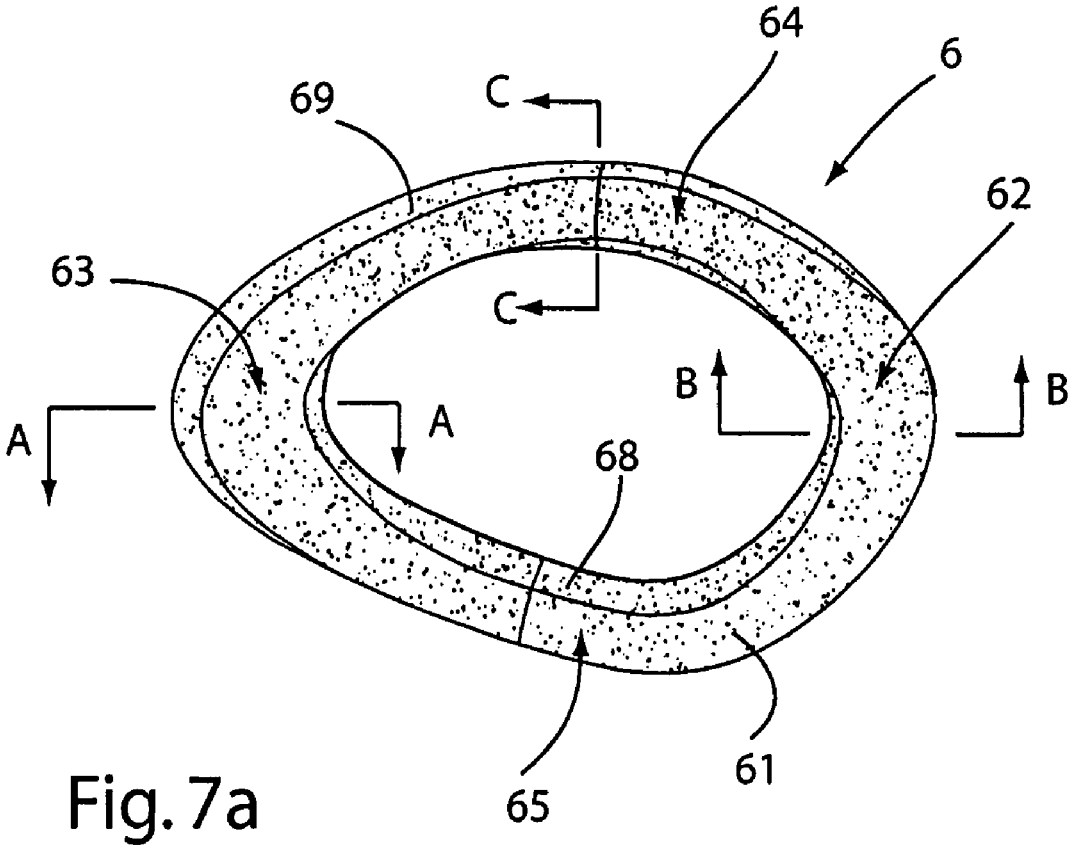
Figure 7B:
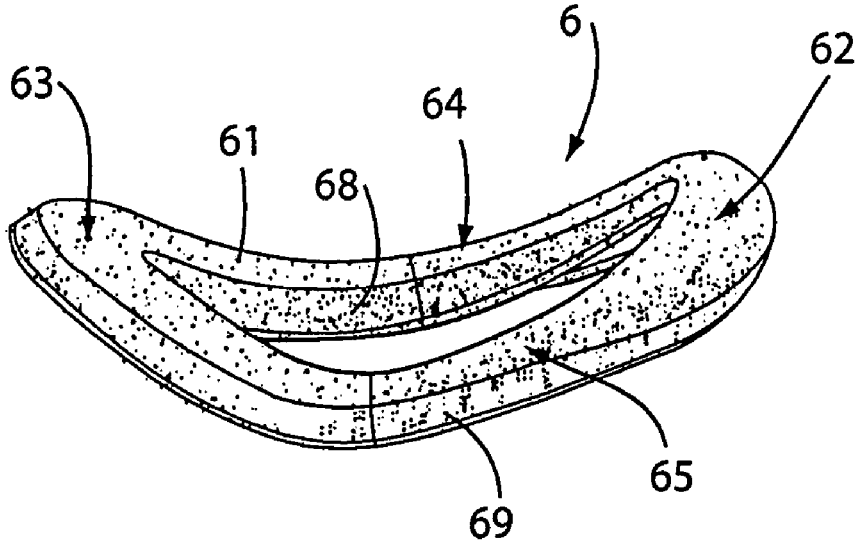
Figure 8A:
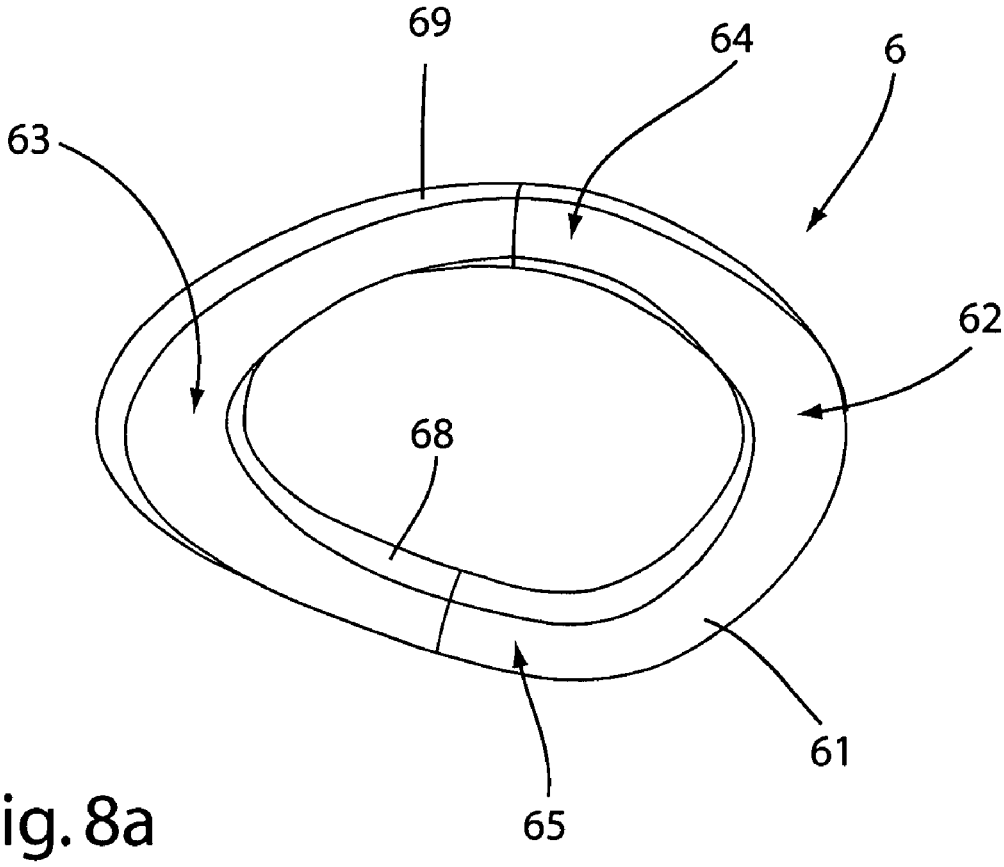
Figure 8B:
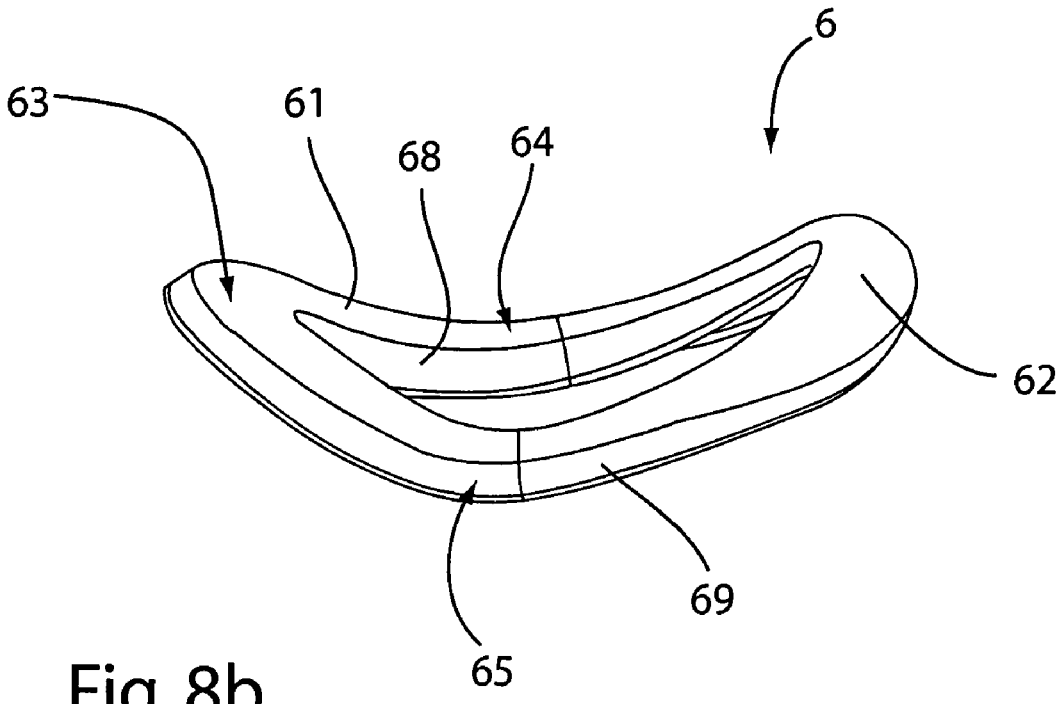

FIG. 5*a* and 5*b* show a shaded rear and side view respectively of the seal portion of the goggles of FIG. 3;

FIG. 6*a* and 6*b* show a line rear and side view respectively of the seal portion of the goggles of FIG. 3;

FIGS. 7*a* and 7*b* show a shaded rear and side view respectively of a seal portion for goggles according to a second embodiment of the present invention;

FIGS. 8*a* and 8*b* show a line rear and side view respectively of the seal portion of FIGS. 7*a* and 7*b;*

Figure 9A:
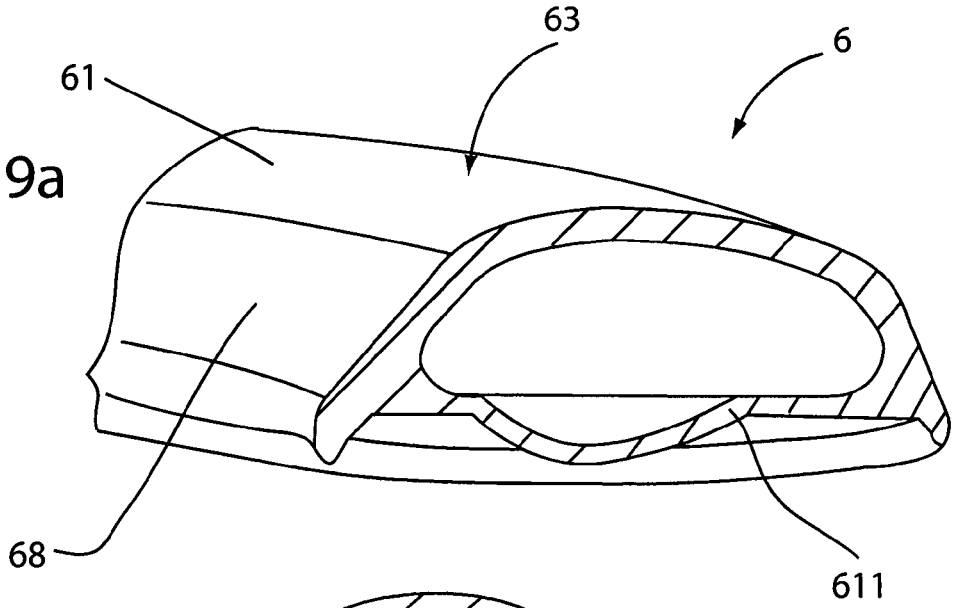
Figure 9B:
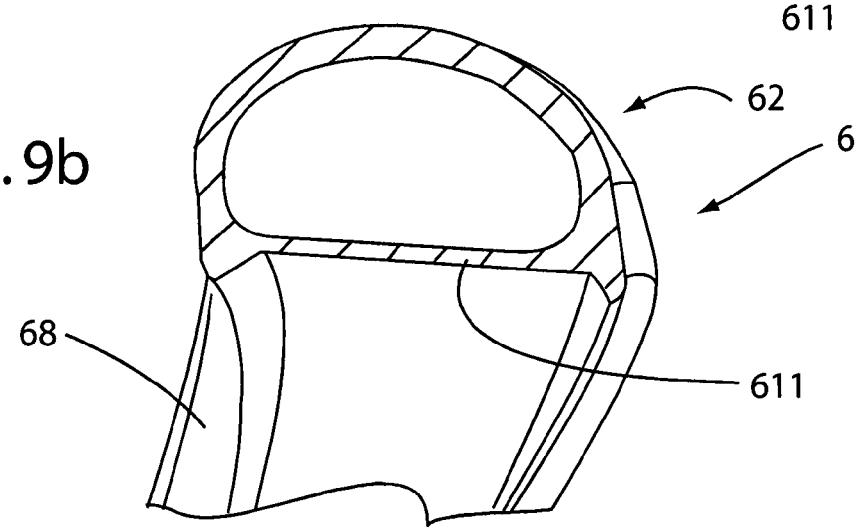
Figure 9C:
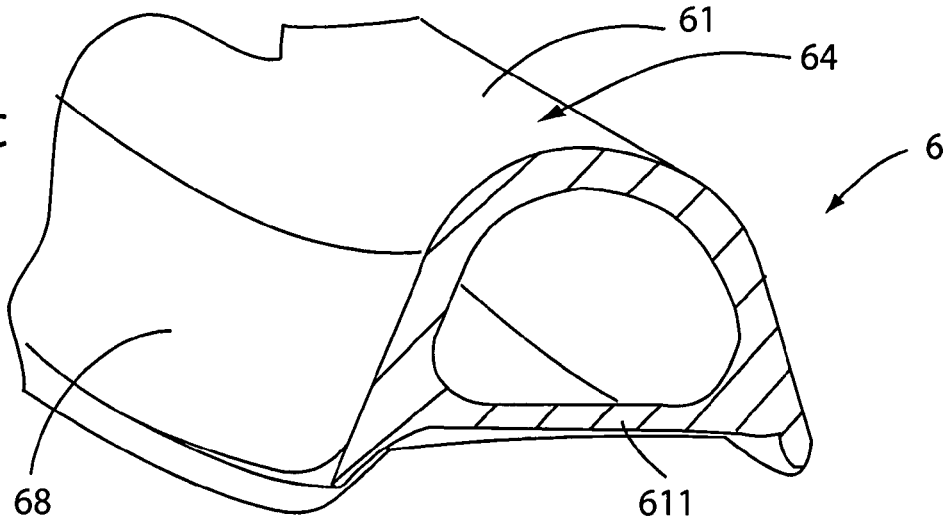
Figure 10A:
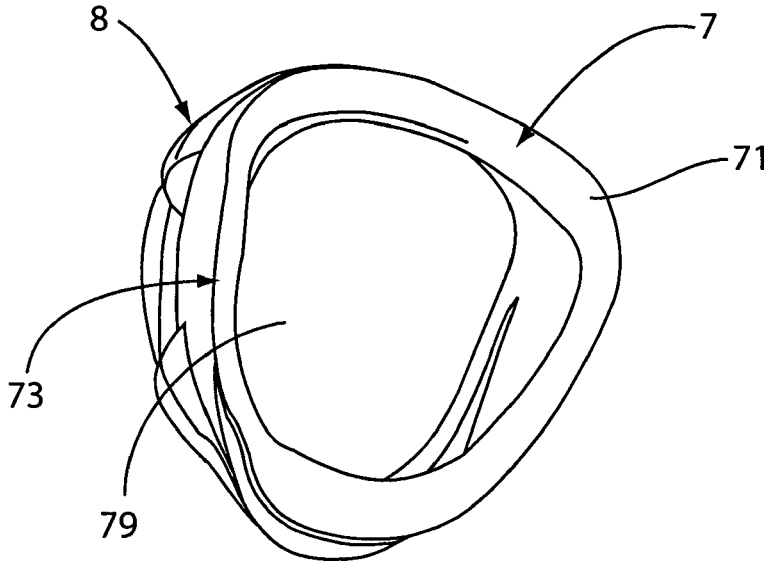
Figure 10B:
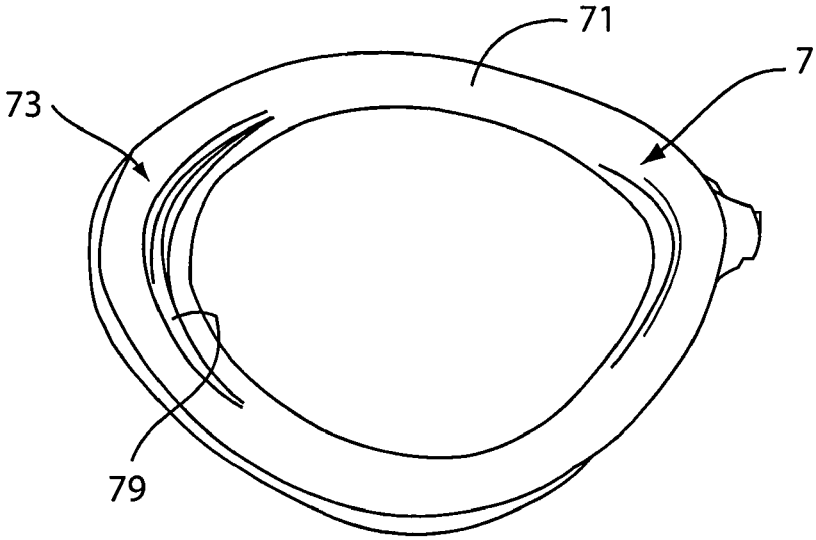
Figure 10C:
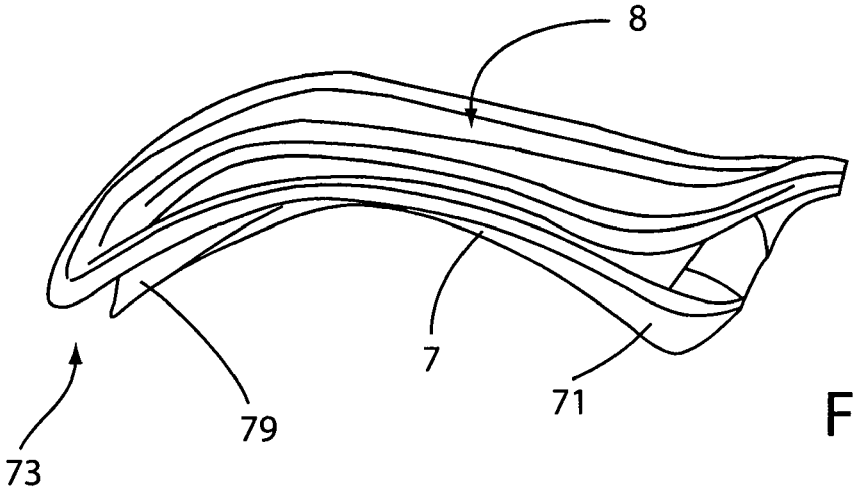

FIGS. 9*a*, 9*b* and 9*c*, show sectional views of the lateral, medial, and upper regions respectively of the seal portion of FIGS. 7*a* and 7*b;* and FIGS. 10*a*, 10*b* and 10*c* show a side oblique view, rear view and top view respectively of a seal portion integral with a lens cup according to a third embodiment of the present invention.

Goggles 3 according to a first embodiment of the present invention are shown in FIG. 3. The goggles comprise two lens cups 31. The lens cups 31 are connected to each other at their medial sides 32 by a nose bridging section 33 that is adapted to extend across the wearer's nose. A head strap 34 is fixed to connection portions 34 at the lateral sides 36 of the lens cups 31 and is adapted to extend round the back of the wearer's head to hold the goggles 3 in position.

Figure 4:
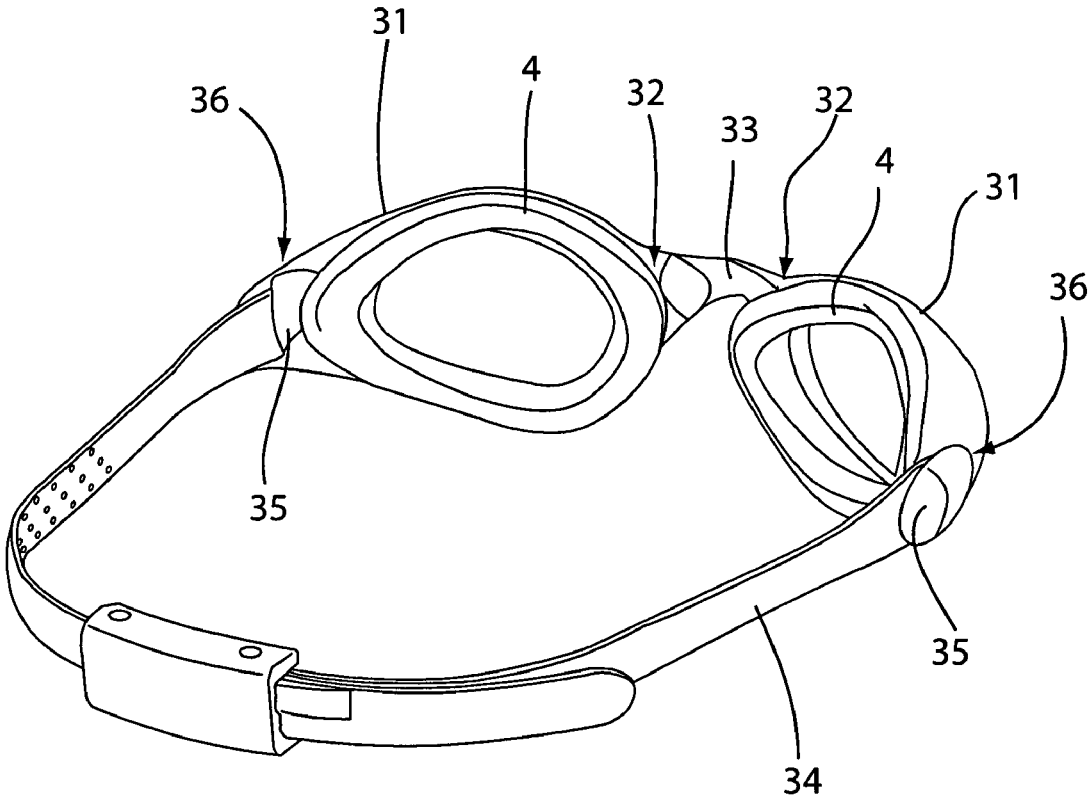
FIG. 4 shows a rear oblique view of the goggles of FIG. 3.

Referring now to FIG. 4, each lens cup 31 includes a rearwardly-directed peripheral seal portion 4 which is adapted to seal against the wearer's face to enclose the space behind the lens cup 31. The seal portions 4 are generally elliptical, and are connected to, and extend around, the peripheral rear edge of the lens cups 31.

In this embodiment, the seal portions have a generally U-shaped cross section, with fill substance being contained in a cavity formed by the U-shape and the peripheral rear edge of the lens cups 31. The fill substance is a gel, making the seal portion 4 resiliently deformable and giving good cushioning properties.

The seal portion 4 of each lens cup 31 has a face contact surface 41, designed to contact the wearers' face, generally around the wearer's eye socket, in use. The seal portion 4 is shaped to follow the contours of the wearer's face at the points of contact with the face. In particular, it is designed to follow the contours of the face over the zygomatic and frontal bone arches, and the side of the nasal bone. By having this 'preformed' shape, little or no distortion of the seal portion may be required for adequate sealing with the wearer's face. The peripheral rear edge of the lens cup 31 is contoured similarly to the face contact surface 41.

The orientation of the face contact surface 41 changes continuously as it extends around the peripheral rear edge of the lens cup 31, in two or three of the x-, y-and z-directions.

As can be seen in FIGS. 5*a* and 6*a*, the angles of the face contact surface 41, across the width of the face contact surface 41, at the medial end 46 of the medial region 42 and at the lateral end 47 of the lateral region 43 are similar. Essentially, at these positions, the face contact surface faces in generally the same direction, with angles relative to the xy-plane of between 30 and 60 degrees. A smooth transition of the face contact surface orientation occurs between these medial and lateral regions, 42, 43 over the upper and lower regions 44, 45 of the face contact surface 41.

In particular, as the face contact surface 41 extends from the medial region 42 to the lateral region 43, via the upper region 44, the local plane (rather than the best fit plane) of the face contact surface 41 rotates anti-clockwise about the z-axis. As it rotates, the angle or slant of the plane changes from the 30 to 60 degree angle relative to the xy-plane at the medial region 42, towards zero degrees relative to the xy-plane (i.e. towards a position where it is, or is almost, parallel to the xy-plane) in the upper region 44, and back to the 30 to 60 degree angle relative to the xy-plane at the lateral region. Whereas, as the face contact surface 41 extends from the medial region 42 to the lateral region 43, via the lower region 44, the local plane of the face contact surface 41 rotates clockwise about the z-axis. As it rotates, the angle or slant of the plane changes from the 30 to 60 degree angle relative to the xy-plane at the medial region 42 mentioned above, towards zero degrees relative to the xy-plane (i.e. towards a position where it is, or is almost, parallel to the xy-plane) at the lower region 45, and back to the 30 to 60 degree angle in the xz plane at the lateral region 43.

The width of the face contact surface 41 is greater at the medial and lateral regions 42, 43 of the face contact surface 41 than at the upper and lower regions 44, 45 of the face contact surface 41.

The width of the face contact surface 41 at the medial region 42 is approximately from 5 mm to 9 mm. A wide face contact surface 41 is desirable at the medial region 42 since, normally, contact forces applied to the face by the medial region 42 are relatively high. By having a wide face contact surface 41, the forces are distributed more evenly to the wearer's face, reducing discomfort and the possibility of reddening of the wearer's face. Forces are normally higher at this position than elsewhere since, at this position, the dominant force applied to the seal portion 4 is via the nose bridging section 33 of the goggles 3, which pulls the seal portion 4 directly toward the nasal bone of the wearer.

The width of the face contact surface 41 at the lateral region 43 is approximately from 8 mm to 12 mm. A wide face contact surface 41 is desirable at the lateral region 43 since, normally, contact forces applied to the face by the lateral region 43 are relatively low. By having a wide face contact surface 41, better sealing is achieved between the face contact 41 surface and the face, despite the low contact forces at this point. Forces are normally lower since, at this position, the dominant force applied to the seal portion 4 is from the head strap of the goggles 3 in a direction substantially perpendicular to the direction of contact between the seal portion 4 and the wearer's face.

The seal portion 4 includes inner side walls 48 and outer side walls 49 that extend forwardly, generally in the z-direction, from the sides of the face contact surface. The inner and outer side walls 48, 49 effectively provide the two sides of the U-shape discussed above, and connect the face contact surface to the lens cup 31. The side walls 48, 49 are approximately 5 mm high, giving the seal portion 4 a depth of approximately 5 mm.

A smooth transition is provided between the contact surface and the side walls, by providing curved corners 481, 491 at the interface. A smooth transition improves comfort for the wearer. Preferably, at the medial region 42 of the face contact surface, the radii of the curved corners 461, 471 are between 1.2 mm and 3 mm. A smooth transition is particularly important at the medial region 42, since the contact force between the face contact surface 41 and the wearer's face is relatively high at this position, and any sharp edges at the interface between the face contact surface 41 and the side walls 48, 49 would be very noticeable to the wearer.

Figure 1:
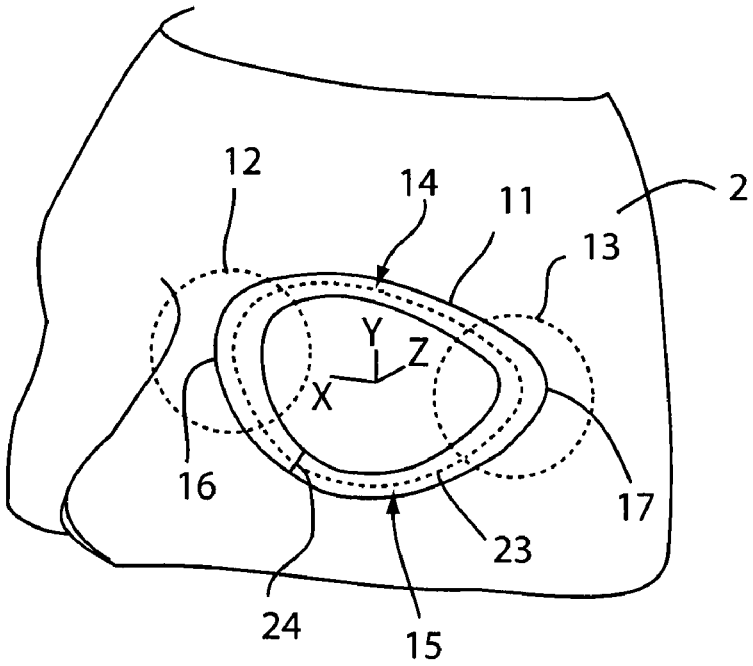
Figure 2A:
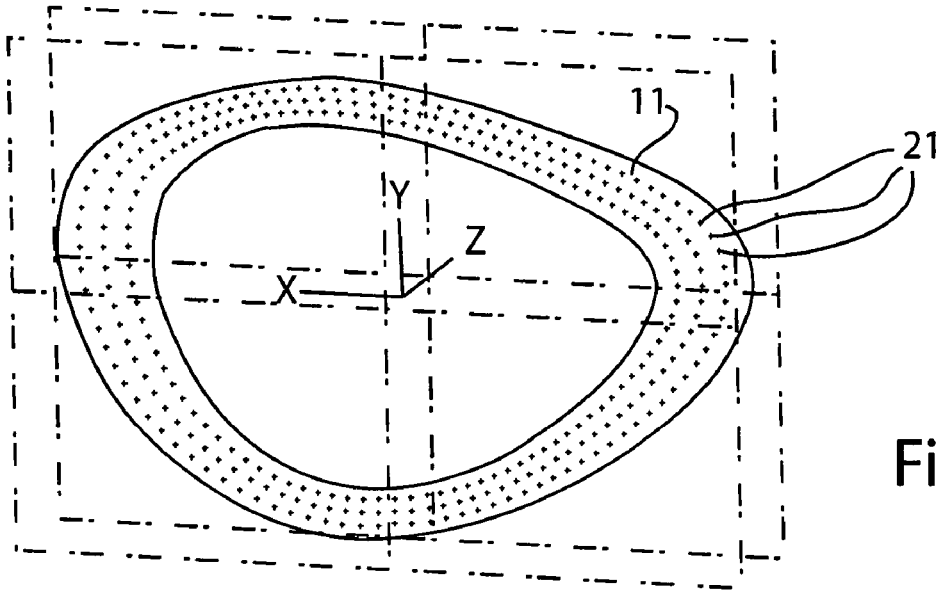
Figure 2B:
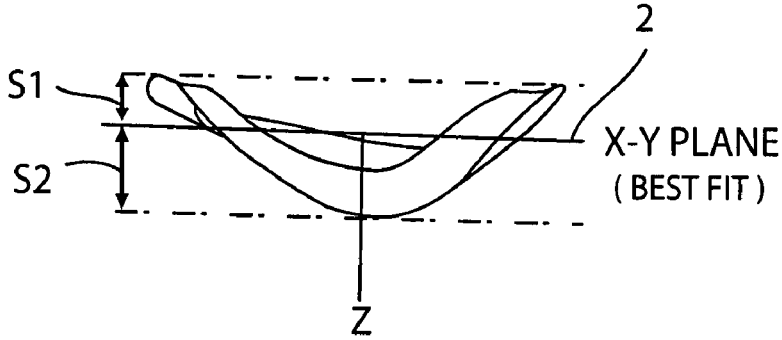

Referring to FIGS. 5*b* and 6*b*, the face contact surface 41, and indeed the seal portion 4 as a whole, is considerably curved in the z-direction. The range of deviation of the face contact surface 41 from the best fit plane is approximately 5 mm in the positive z-direction (e.g. as denoted by the arrow 51 in FIG. 2*b*, and approximately 8 mm in the negative z-direction (e.g. as denoted by the arrow 52 in FIG. 2*b*). This degree of curvature enables the face contact surface 41 to follow substantially the contours of the wearer's face around the eye socket.

The ratio of the spatial extent of the face contact surface in the x-direction, as indicated by arrow 53 in FIG. 5*a* to the spatial extent of the face contact surface in the y-direction as indicated by arrow 54 in FIG. 5*a*, is approximately 1.4. The distance in the y-direction between the upper and lower regions 44, 45 of the face contact surface 41 is approximately 35 mm. This size configuration means that the seal portion 4, and lens cup 31 do not interfere with the natural movement of the eye and eye lid when worn.

A seal portion 6 for goggles according to a second embodiment of the present invention is shown in FIGS. 7*a*, 7*b*, 8*a*, 8*b* and 9*a* to 9*c*.

The seal portion 6 is similar to the seal portion 4 of the first embodiment of the present invention, and offers similar advantages. However, there are at least two main differences. Firstly, the seal portion 6 is tubular. Accordingly, a fill substance such as gel (not shown), may be contained entirely within the cavity 69 of the seal portion. (To complete the tubular shape, in addition to the face contact surface 61 and side walls 68, 69, a back panel 611 of the seal portion is provided.) Furthermore, the face contact surface 61 of the seal portion 6 blends into the sidewalls 68, 69 of the seal portion in such a manner that there are no corner portions therebetween. Since there are no corner portions, the face contact surface 61 is generally smoother and therefore more comfortable for the wearer.

The tubular configuration of the seal portion 6, and the smooth transition between the face contact surface 61 and the sidewalls 68, 69 can be seen most easily in FIGS. 9*a* to 9*c* which show sectional views along lines A-A, B-B and C-C of FIG. 7*a*, respectively.

The seal portion has a relatively flat cross-section at the lateral region 63 of the seal portion 6, as shown in FIG. 9*a*. The cross section is asymmetric at the medial region of the seal portion 6, as shown in FIG. 9*b*, whereas the cross section is relatively symmetrical at the upper region 64 of the seal portion 6, as shown in FIG. 9*c*.

FIGS. 10*a* to 10*c* show a seal portion 7 according to a third embodiment of the present invention. The seal portion 7 is integral with a lens cup 8. The peripheral rear edge of the lens cup 8 provides the face contact surface 71 of the seal portion 7. The face contact surface 71 is contoured in generally the same manner as the seal portions 4, 6 of the first embodiment of the present invention, so that it follows the contours of the wearer's face around the eye socket. However, the seal portion 8 includes a flange 79. The flange 79 extends from the face contact surface 71 only at the lateral region 73 of the face contact surface. The flange extends along the central axis of the face contact surface at the lateral region. The flange 79 is resiliently deformable and provides an additional sealing surface to the seal portion 8, improving further its sealing properties. Having the flange 79 at the lateral region 73 is particularly advantageous, since forces between the face contact surface and the lateral region are fairly low, so it is harder to achieve an effective seal at this position.

The invention claimed is:

1. Goggles, comprising:

a lens cup having a peripheral rear edge;

a seal portion extending around the peripheral rear edge, adapted to seal against a wearer's face;

the seal portion having a medial region for location adjacent the nose of the wearer, a lateral region at an opposite end of the seal portion from the medial region, and upper and lower regions between the lateral and medial regions;

the seal portion having a face contact surface and sidewalls extending either side of the face contact surface, the sidewalls connecting the face contact surface to the lens cup, the orientation of the face contact surface changing continuously in two or more of the x-, y- and z-directions of the lens cup as the face contact surface extends around the peripheral rear edge of the lens cup, the z-direction extending, when the goggles are worn, normal to the surface of the center of the wearer's eye and the x- and y-directions extending respectively, when the goggles are worn, horizontally across the wearer's face, and vertically across the wearer's face, the orientation of the face contact surface changing such that the face contact surface faces in substantially the same direction at the lateral and medial regions of the seal portion, wherein, (i) curved corner portions are provided at the transition between the sidewalls and the face contact surface, or (ii) the face contact surface blends into the sidewalls so that there are no corner portions, to provide a smooth transition between the face contact surface and the sidewalls.

2. The goggles of claim 1, wherein a viscous fill substance is located in a cavity provided between the face contact surface, sidewalls and the peripheral rear edge of the lens cup.

3. The goggles of claim 1, wherein the corners are curved and the radii of the curved corners are between 1.2 mm and 3 mm.

4. The goggles of claim 1, wherein the peripheral rear edge of the lens cup is contoured in a similar or identical manner to the face contact surface.

5. The goggles of claim 1, wherein the seal portion comprises a flange projecting from the face contact surface.

6. The goggles of claim 1, wherein the face contact surface is preformed to follow the facial contours of the average wearer of a demographic group or preformed bespoke to a wearer.

7. The goggles of claim 1, wherein the width of the face contact surface is greater at the medial and/or lateral regions than at the upper and lower regions.

8. The goggles of claim 1, wherein the width of the face contact surface is from 5 mm to 9 mm at the medial region.

9. The goggles of claim 1, wherein the width of the face contact surface is from 8 mm to 12 mm at the lateral region.

10. The goggles according to claim 1, wherein the ratio of the spatial extent of the face contact surface in the x-direction to a spatial extent of the face contact surface in the y-direction is between 1.4 and 1.5.

11. The goggles of claim 1, wherein the range of deviation of the face contact surface in the z-direction from its best fit plane is at least: 2 mm, 3 mm or 5 mm, either side of the best fit plane.

12. The goggles of claim 1, wherein the total deviation of the face contact surface in the z-direction is at least: 5 mm or 10 mm.

13. The goggles of claim 1, wherein the face contact surface has an angle at the medial region and the lateral region of between 30 and 60 degrees relative to an xy-plane.

14. The goggles according to claim 1, wherein the width of the face contact surface is greater at the lateral region than at the upper and lower regions.

15. The goggles according to claim 1, wherein the width of the face contact surface is greater at the lateral region and the medial region than at the upper and lower regions.

* * * * *